US006997641B2

(12) United States Patent
Gaertner et al.

(10) Patent No.: US 6,997,641 B2
(45) Date of Patent: Feb. 14, 2006

(54) ROAD MILLING MACHINE WITH STEERING GEAR

(75) Inventors: Olaf Gaertner, Linz/Rhein (DE); Dieter Bungarten, Neustadt/Wied (DE); Roland Lull, Konigswinter (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 10/961,917

(22) Filed: Oct. 8, 2004

(65) Prior Publication Data

US 2005/0093282 A1 May 5, 2005

(30) Foreign Application Priority Data

Oct. 10, 2003 (DE) ..... 103 47 873

(51) Int. Cl.
*E01C 23/00* (2006.01)

(52) U.S. Cl. ..... 404/93

(58) Field of Classification Search ..... 180/78, 180/315, 320, 323, 326; 280/775, 778, 779, 280/780; 404/90–94
See application file for complete search history.

(56) References Cited

U.S. PATENT DOCUMENTS 3,216,521 A * 11/1965 Ulrich ..... 180/78
3,362,247 A * 1/1968 Watts ..... 74/493
3,520,209 A * 7/1970 Cescone ..... 74/493
3,583,519 A * 6/1971 Meyer et al. ..... 180/90
3,808,784 A * 5/1974 Gardner et al. ..... 56/208
3,834,754 A * 9/1974 Zejichek ..... 296/35.1
3,895,843 A 7/1975 Wall et al. ..... 299/39
4,059,171 A * 11/1977 Pakosh ..... 180/328
4,299,407 A * 11/1981 Simson ..... 280/775
4,359,882 A * 11/1982 Peifer et al. ..... 70/168
4,365,826 A * 12/1982 Iriyama ..... 280/779
4,600,236 A * 7/1986 Weiss et al. ..... 296/190.03
4,733,745 A * 3/1988 Lumpkins ..... 180/315
5,016,722 A * 5/1991 Morita et al. ..... 180/89.14
5,036,942 A * 8/1991 Loewen ..... 180/329
5,092,422 A * 3/1992 Hood et al. ..... 188/329
5,632,353 A * 5/1997 Kimberley ..... 180/326
5,639,181 A * 6/1997 Swisher, Jr. ..... 299/39.1
6,068,295 A * 5/2000 Skabrond et al. ..... 280/775
6,106,073 A * 8/2000 Simons et al. ..... 299/39.6

* cited by examiner

*Primary Examiner*—Thomas B. Will
*Assistant Examiner*—Alexandra Pechhold
(74) *Attorney, Agent, or Firm*—Heslin Rothenberg Farley & Mesiti P.C.

(57) ABSTRACT

A road milling machine has a driver's cab equipped with a floor plate and a steering gear mounted on the chassis of the road milling machine. The steering gear includes a console, on which a steering wheel is positioned. One end the console is fastened laterally to the chassis, while the other end of the console is not attached to anything. The console extends over the floor plate, forming an opening between the floor plate and the console on a side. Since this opening is below the console, it is possible for the operator to observe the road surface without having to lean to the side, as is necessary with conventional road milling machines, in which the side of the chassis on which the console is positioned blocks the view.

16 Claims, 4 Drawing Sheets

4
10
14
62
30
63
34
40
28
32
18
38
b
a
8
36
c
d
e
f
26
C
16
20
6
12
2
22
24

ROAD MILLING MACHINE WITH STEERING GEAR

BACKGROUND OF THE INVENTION

The present invention relates to a road milling machine with a driver's cab that is equipped with a floor plate and a steering gear attached to the chassis of the machine. The steering gear consists of a console with a steering wheel.

There are road milling machines that have a driver's cab on the chassis. The driver's cab has a floor plate for the vehicle's operator to stand on. Most driver's cabs also have a seat mounted on the floor plate where the operator can sit down when working on a road surface for extended periods of time.

The steering gear in current road milling machines generally consists of a console on which the steering wheel is positioned. The console is positioned on a completely closed side of the chassis facing the driver's cab. The steering itself is usually performed by means of a hydraulic system.

When working on a road surface with a road milling machine, the operator often has to keep an eye on the road surface being worked on. For example, the road milling machine must often follow markings on the road surface. The operator must always make sure that the road milling machine travels precisely along these markings. In addition, when working on a road surface along a curb or around a manhole cover, the operator must always monitor the edges of the surface being worked on as defined by the above-mentioned obstacles.

Current road milling machines have the disadvantage that monitoring the road surface being worked on from the driver's cab is difficult.

A road milling machine is known from U.S. Pat. No. 3,895,843 whose milling tool is placed in front of the driver's cab in the direction of travel. The milling tool is partially visible from the driver's cab through a cutout in the floor plate. The disadvantage of this is that the view of the milling tool is impeded by the console and its instruments and by the steering column extending up from the floor plate. Furthermore, this arrangement restricts the operator's legroom.

BRIEF SUMMARY OF THE INVENTION

The present invention thus arose from the task of producing a road milling machine that allows simple and comfortable monitoring of the road surface being worked on from the driver's cab.

The road milling machine according to the invention has a driver's cab with a floor plate. The operator can stand on this floor plate. If an appropriate seat is mounted on the floor plate, the operator can also sit down. A steering gear is attached to the chassis of the road milling machine. This steering gear is used to steer, e.g., a wheel, the wheels of an axle, or the tracks on which a road milling machine is usually supported. The steering gear consists of a console and a steering wheel positioned on it. In this context, "steering wheel" refers to any kind of hand-operated means of steering. According to the invention, one end of the console is fastened laterally to the chassis. The term "lateral" is to be understood in relation to the direction of travel. Starting from the attached end, the console is positioned up over the floor plate; thus, an opening is created on the side between the floor plate and the console. The term "over" means that the console is positioned higher than the floor plate. It is not necessary to position the console directly above the floor plate. The other end of the console is not attached to anything.

The opening below the console allows the operator to observe the road surface the machine is working on without having to lean to the side, as is necessary with conventional road milling machines. On conventional road milling machines, the side of the chassis where the console is positioned blocks the view. Furthermore, attaching the console to the chassis at one end only means that one end of the console is free and does not have to be supported at the bottom against the chassis, i.e., it needs no other means of support that could impede the view. Furthermore, the opening beneath the console gives the operator more legroom. The floor plate cutout, through which the operator views the tarmac, can extend over part or over the whole length of the floor plate.

The console of the road milling machine according to the invention does not need to be positioned laterally on the exterior side panel of the chassis but can also be placed further back in the interior behind a part of the chassis, as seen from the direction of travel. In an especially advantageous embodiment of the road milling machine, the console is positioned further toward the interior, and the chassis has a cutout in front of the opening for the console, as seen from the direction of travel, in such a way that the tarmac is visible. Thus, the total width of the road milling machine is reduced since the console does not protrude beyond the exterior side panel of the chassis, and the road surface being worked on remains perfectly visible.

In another especially advantageous embodiment of the road milling machine according to the invention, the steering wheel can be swiveled around the longitudinal axis of the console. In this way, the position of the steering wheel can be adjusted depending on whether the operator is standing or sitting.

In another advantageous embodiment of the road milling machine according to the invention, the steering wheel can be swiveled together with the console. Preferably, additional operating and/or display elements can be positioned on the console so that their position relative to the steering wheel remains constant and they are thus easier to operate.

In another preferred embodiment, the steering wheel can be locked in various swivel positions in order to ensure safe and steady steering. Locking the steering wheel in position allows incremental or infinitely variable adjustment of the swivel position.

In order to allow simple assembly of the road milling machine according to the invention and to simplify replacement of the steering gear, one advantageous embodiment of the road milling machine is designed in such a way that the console is removable from the chassis.

In another advantageous embodiment, the console can be mounted in the direction of its longitudinal axis on the chassis and fastened by rotating the console once around its longitudinal axis. This allows a particularly easy assembly/disassembly of the steering gear. In this context, "fastened" means that the console cannot be moved any further in the direction of its longitudinal axis and therefore cannot be pulled out. This could also be called a bayonet lock.

Preferably, the road milling machine, according to the invention, has hydraulic steering. In an especially advantageous embodiment of the invention, the control elements of the hydraulic steering are positioned inside the console and can be operated via the steering wheel.

BRIEF DESCRIPTION OF THE DRAWINGS

The invention is explained in detail in what follows using one embodiment as example and referring to the enclosed Figures.

The Figures show.

DETAILED DESCRIPTION

Figures 1, 1A:
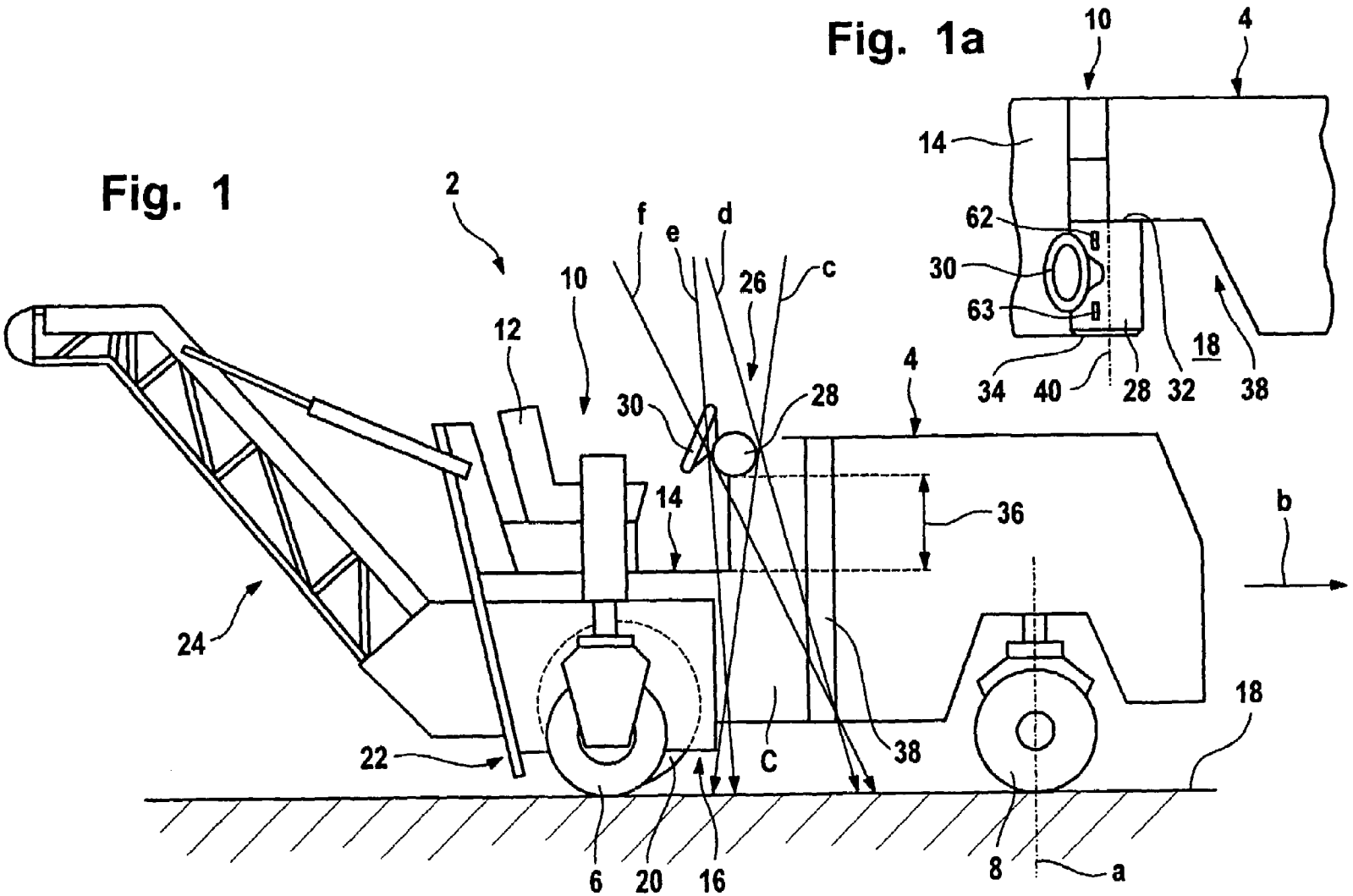
FIG. 1: a schematic illustration of a rear-loading road milling machine, according to the invention; lateral view.
FIG. 1*a*: a partial top view of the road milling machine in FIG. 1.

The road milling machine (2) has a chassis (4) that is supported in the present embodiment on three wheels (6, 6, 8), where the two rear wheels (6, 6) (only one can be seen in FIG. 1) are located on the sides in the rear, and the front wheel (8) is located in the center of the front end of the road milling machine (2). The height of the rear wheels (6, 6) can be adjusted by a hydraulic system, and the road milling machine (2) is steered via the front wheel (8), which can be rotated around a vertical axis (a). Alternatively, this type of road milling machine (2) can be supported on tracks instead of on the wheels (6, 6, 8). The number of wheels or tracks can vary.

Furthermore, there is also at least one drive motor for a cutter and the wheels (6,6,8) and a hydraulic system provided inside the chassis (4). Furthermore, additional state-of-the-art drive systems are provided, but these are not shown in the drawings for reasons of clarity.

The driver's cab (10) is provided on top at the rear of the road milling machine (2), where, among other things, there is a seat (12) for the operator; the seat is positioned on a floor plate (14). The road milling machine (2) can be operated with the operator either standing on the floor plate (14) or sitting on the seat (12).

There is a cutter housing (16) positioned below the driver's cab (10). The cutter housing (16) is open at the bottom toward the tarmac. This housing contains a rotary cutter (20) whose longitudinal axis extends at right angles to the direction of travel, which is indicated in FIG. 1 by the arrow (b). The rotary cutter (20) protrudes downward beyond the cutter housing (16) toward the tarmac (18).

A height-adjustable scraper unit (22) is provided at the rear end of the cutter housing (16), as seen from the direction of travel. A transport unit (24) is provided behind the scraper unit (22), as seen from the direction of travel (b). This transport unit may be used to transfer the milled material to an accompanying truck with an appropriate loading area (not shown). Since the milled material is transferred to the truck from the rear end of the road milling machine, the machine is a rear-loading road milling machine. However, road milling machines can also be front loaders.

Furthermore, there is a steering gear (26) comprising a console (28) and a steering wheel (30) positioned on the console (28) in the driver's cab (10). At one end (32), the console (28) is attached laterally to the chassis (4). The other end of the console (28) is an unattached end (34). Starting from its attached end (32), the console (28) extends at right angles to the direction of travel (b) to the side, with the console extending up from the floor plate (14) and thus forming an opening (36) between the floor plate (14) and the console (28).

As can be seen from FIG. 1*a*, the console (28) is mounted on a side panel of the chassis (4) that has been moved back to the interior of the driver's cab (10). In order to give the operator (not shown) in the driver's cab (10) a clear view of the tarmac (18) through the opening (36), the road milling machine (2), or rather the chassis (4) of the road milling machine (2) in the embodiment shown, has a cutout (38) located in front of the opening (36), as seen from the direction of travel (b). That is, as seen from the direction of travel (b), there is a cutout (38) in front of the opening (36), and, in the embodiment shown, this cutout (38) extends over the complete height of the chassis (4). When the operator is sitting, he can view the tarmac (18) through the opening (36) and the cutout (38). When the operator is standing and leaning forward, he can look directly through the cutout (38).

The steering wheel (30) can be swiveled around the longitudinal axis (40) of the console (28); it is preferable that the console (28) is rotated together with the steering wheel (30) around the axis (40). This makes it possible to optimally adjust the position of the steering wheel to whether the operator is sitting or standing. It is thus also possible to make adjustments for the operator's height. Being able to swivel the steering wheel is also advantageous in certain special applications because swiveling the steering wheel allows viewing the tarmac from different angles. To illustrate this, different angles of vision for the operator are indicated in FIG. 1 by arrows (c, d, e, f). These arrows show that different angles of vision are cleared depending on the position of the steering wheel. In certain driving situations it can be useful for the operator to be able to swivel the steering wheel, regardless of the ergonomic aspects, so that the steering wheel does not block the view of the road.

The steering wheel (30) can be locked in various swivel positions. Furthermore, the console (28) is removable from the chassis (4). The console (28) is easily mounted on the chassis (4) and is fastened by rotating it once around its longitudinal axis (40). Referring to FIGS. 2 through 5, what follows describes how the above-mentioned characteristics can be achieved in a particular embodiment.

The console (28) has an essentially cylindrical housing (42), where the wall of the housing (42) is designed in one part as a flat surface (44). The steering wheel (30) is mounted on this flat surface; it is not shown in the FIGS. 2 through 5 for reasons of clarity. The housing is open at the free end (34) of the console (28) to ensure easy access to the components (not shown) of the hydraulic steering. However, the console (28) should be protected with a cover (46), which is indicated in FIG. 3 by means of a dashed line.

Figure 2:
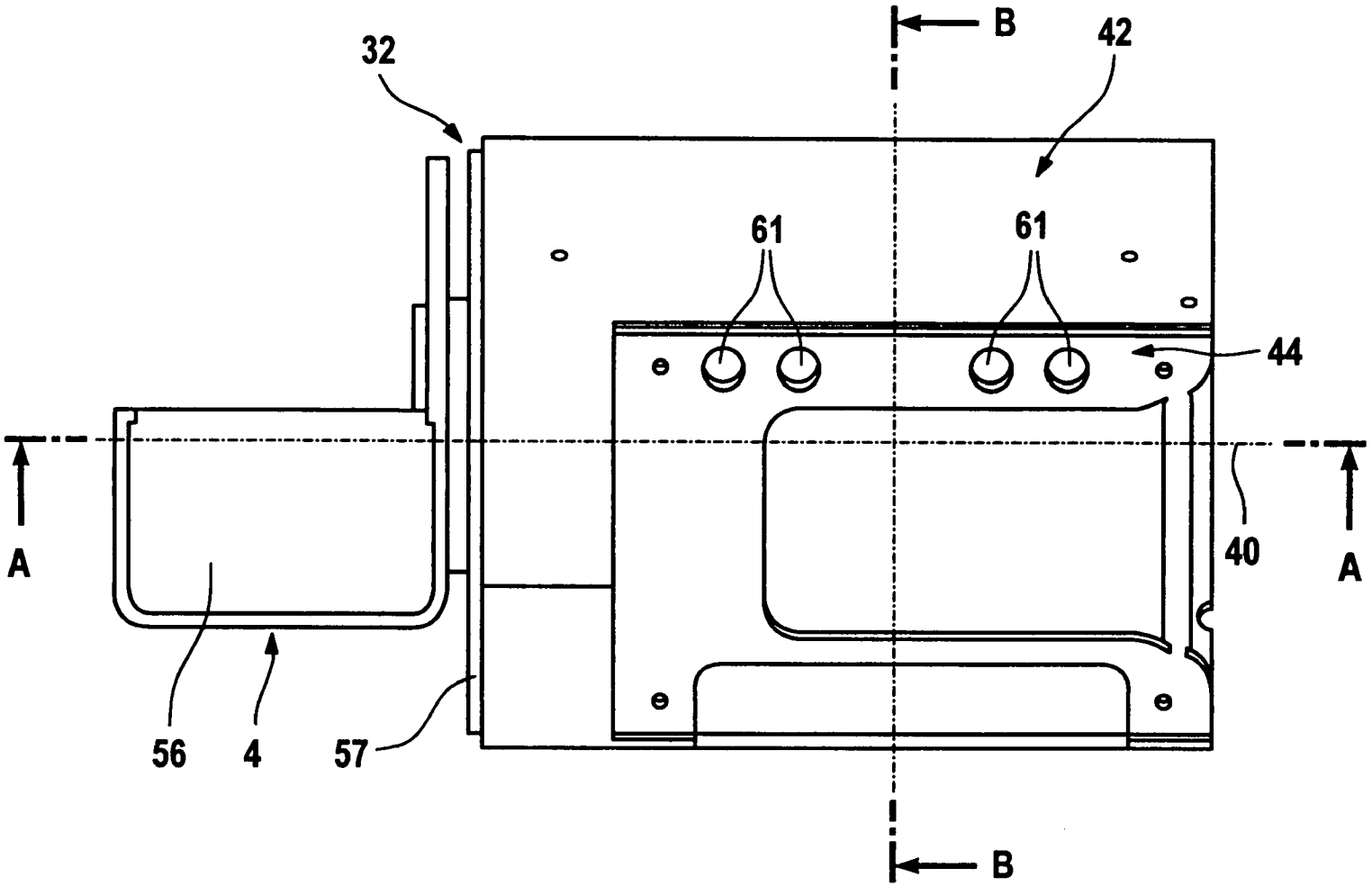
FIG. 2: a top view of the console in FIG. 1, in which the steering wheel is not shown.
Figure 3:
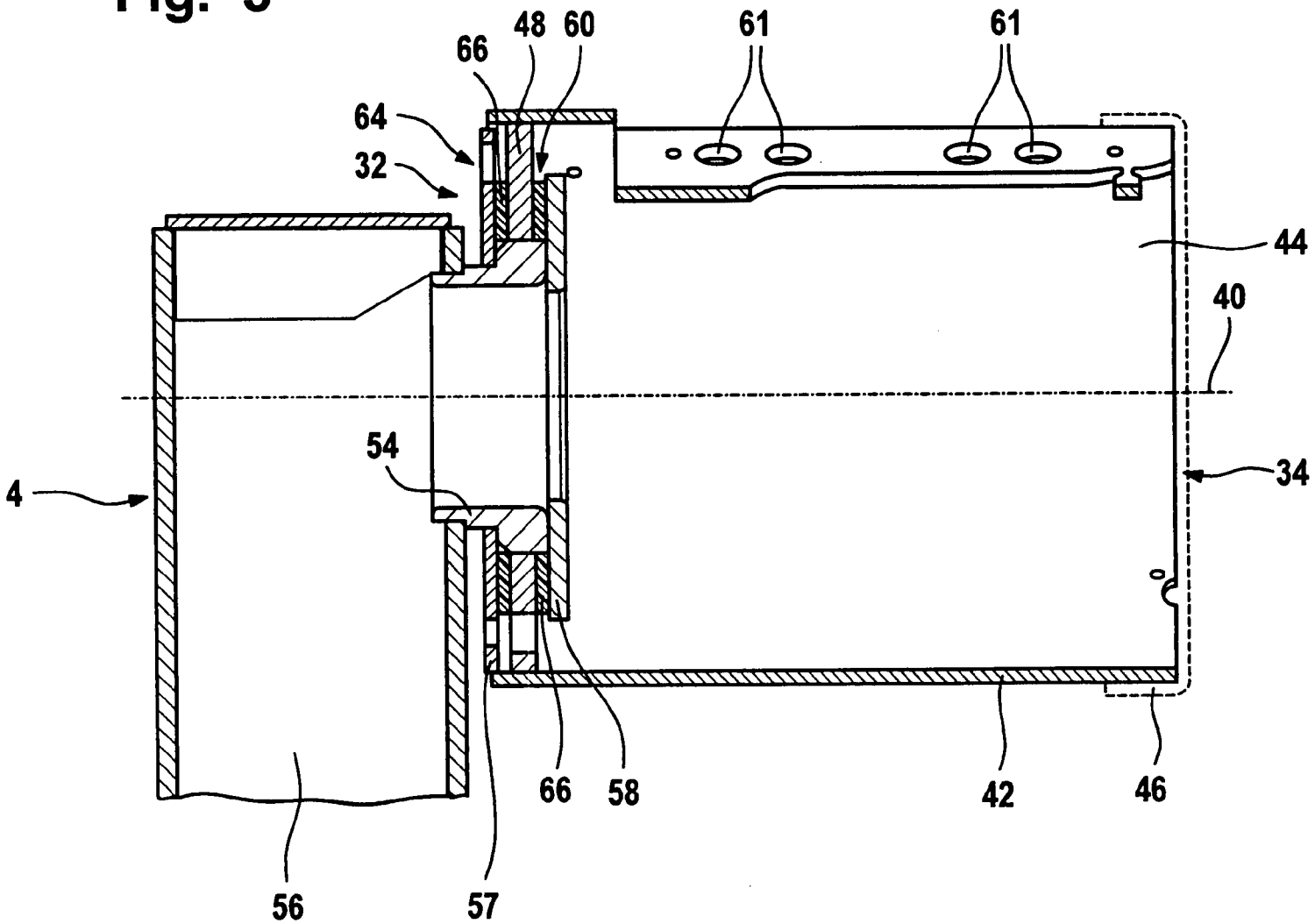
FIG. 3: a section along the line A—A from FIG. 2.

The wall of the housing (42) has several openings (61) on the flat surface (44) for mounting operating and/or display elements (62, 63) (not shown in FIG. 2). These elements (62, 63) are positioned on the top of the console next to the steering wheel (FIG. 1*a*). The conduits (not shown in the figures) for these operating and display elements are routed together with the hydraulic hoses (also not shown) along the longitudinal axis (40) through the tubular axle (54) into the hollow space (56) on the chassis side. Since the conduits are long enough, they can be twisted without being damaged when the console is swiveled.

Figure 5:
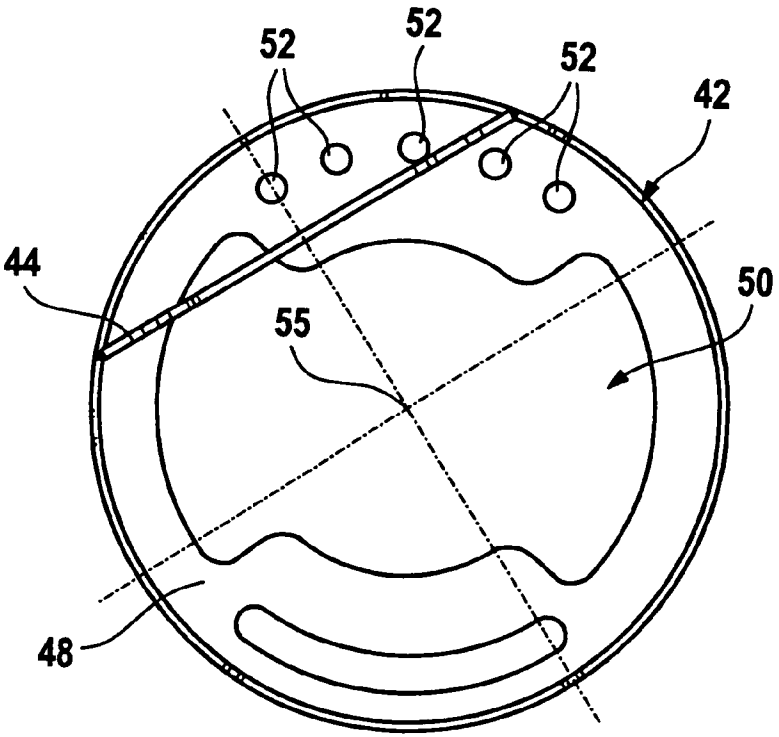
FIG. 5: a section along the line B—B from FIG. 2, in which the chassis is not shown; only the console is visible.
Figure 4:
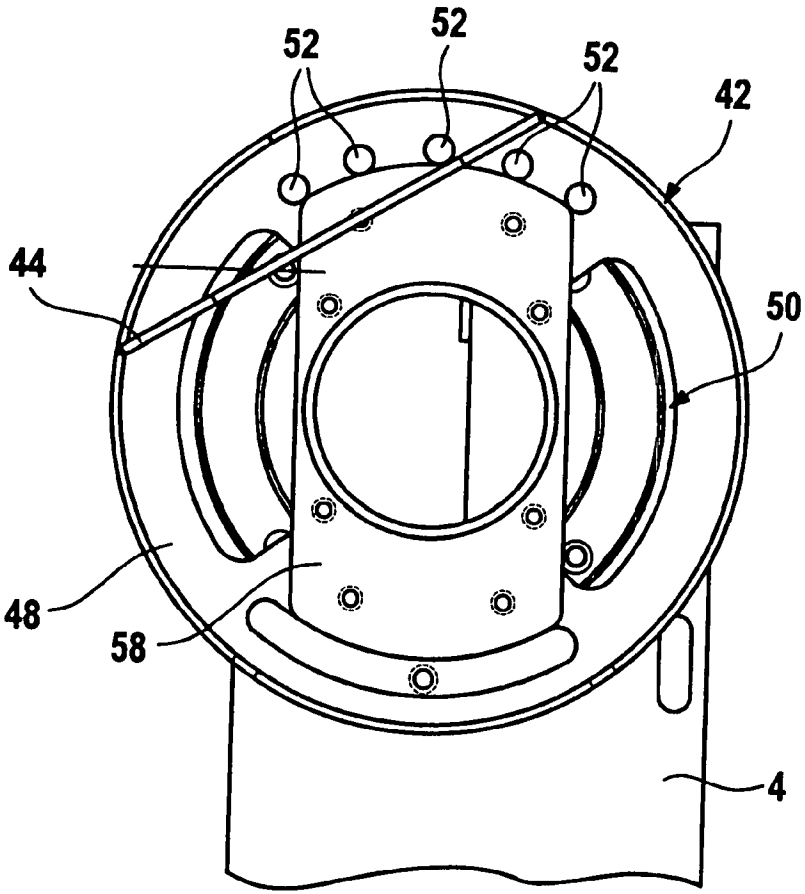
FIG. 4: a section along the line B—B from FIG. 2.

At the end (32) facing the chassis (4), the console (28) has a connecting plate (48) that is shown in detail in FIG. 5. The connecting plate (48) has an oblong connection opening (50). Furthermore, several locking holes (52) are provided in the connection plate (48); these holes are all placed at the same distance from the center point (55) of the connection plate (48).

A fixed tubular axle (54), which runs into a chassis hollow space (56), is provided on the side of the chassis. The hydraulic hoses can be routed through this hollow space. There are two flanges (57, 58) provided on the axle (54), where the flange (58) facing the console is essentially oblong and can be passed through the connection opening (50) when the connection plate (48) is in a certain swiveled position. The flange (57) facing the chassis (4) is positioned at a certain distance from the flange (58), so that a ring-shaped slot (60), pointing to the outside, is formed between the two flanges. Furthermore, lubricants or sealants (66) are provided in the form of slip-rings or sealing washers on the sides of the flanges (57, 58) that are facing each other.

In order to connect the console (28) to the chassis (4), the former is slid onto the axle (54) in a swiveled position. The oblong flange (58) can be passed through the connection opening (50) of the axle (54). Then the console is rotated around its longitudinal axis (40) so that the edge of the connection opening (50) comes to lie in the slot (60) between the two flanges (57, 58). In this position, the console (28) can no longer be pulled off in the direction of the longitudinal axis (40); that is, it is securely fastened to the chassis (4). This is also called a bayonet lock. In order to lock the console (28) in a certain swivel position, a preloaded bolt (not shown), for example, can be put into the arrest hole (64) in the secured flange (57) and into one of the locking holes (52). This prevents the console (28) and the steering wheel attached to it (but not shown) from being rotated any further.

We claim:

1. A road milling machine having a driver's cab with a floor plate, and a steering gear mounted on a chassis of the road milling machine, the steering gear including a console on which a steering wheel is positioned, wherein the console is fastened laterally at one end to the chassis, while an other end of the console is not attached to anything, and the console is positioned over the floor plate, and an opening extends between the floor plate and the console, the chassis of the road milling machine having a cutout in front of the opening, as seen from a direction of travel of the machine, whereby a road surface the machine is working on is visible through the opening and cutout.

2. The road milling machine according to claim 1, wherein the cutout is within an area of the opening, whereby road surface below the console is visible through the opening.

3. The road milling machine according to claim 1, wherein the steering wheel can be swiveled around a longitudinal axis of the console.

4. The road milling machine according to claim 3, wherein the steering wheel can be swiveled together with the console.

5. The road milling machine according to claim 3, wherein the steering wheel can be locked in various swivel positions.

6. The road milling machine according to claim 1, wherein the console can be removed from the chassis.

7. The road milling machine according to claim 6, wherein the console can be mounted on the chassis in a direction of a longitudinal axis of the console, and can be locked into place by rotating the console once around its longitudinal axis.

8. The road milling machine according to claim 1, wherein hydraulic steering is provided.

9. The road milling machine according to claim 8, wherein elements of the hydraulic steering are placed inside the console and can be operated via the steering wheel.

10. The road milling machine according to claim 1, wherein operating and/or display elements are positioned on the console.

11. The road milling machine according to claim 1, wherein the console is fastened laterally at said one end to a side panel of the chassis.

12. The road milling machine according to claim 11, wherein the console has a generally cylindrical outer housing and a connecting plate at said one end for fastening the housing to said side panel.

13. The road milling machine according to claim 12, wherein a portion of a wall of the housing comprises a flat surface on which is mounted the steering wheel.

14. The road milling machine according to claim 11, wherein the console is supported solely at said one end.

15. The road milling machine according to claim 1 wherein said cutout extends through said floor plate.

16. The road milling machine according to claim 15, wherein said cutout extends under said console.

* * * * *